US009546670B2

(12) United States Patent
Malec

(10) Patent No.: US 9,546,670 B2
(45) Date of Patent: Jan. 17, 2017

(54) JET PUMP FOR DELIVERING FUEL

(75) Inventor: Radek Malec, Ceske Budejovice (CZ)

(73) Assignee: Robert Bosch GmbH, Stuttgart (DE)

( * ) Notice: Subject to any disclaimer, the term of this patent is extended or adjusted under 35 U.S.C. 154(b) by 562 days.

(21) Appl. No.: 14/115,419

(22) PCT Filed: Mar. 6, 2012

(86) PCT No.: PCT/EP2012/053787

§ 371 (c)(1),
(2), (4) Date: Nov. 4, 2013

(87) PCT Pub. No.: WO2012/150059

PCT Pub. Date: Nov. 8, 2012

(65) Prior Publication Data

US 2014/0079567 A1 Mar. 20, 2014

(30) Foreign Application Priority Data

May 4, 2011 (DE) ..... 10 2011 075 230

(51) Int. Cl.

| | |
|---|---|
| ***F04F 5/46*** | (2006.01) |
| ***F02M 37/02*** | (2006.01) |
| ***F04F 5/10*** | (2006.01) |
| ***F04F 5/42*** | (2006.01) |
| *F02M 37/10* | (2006.01) |
| *F02M 37/22* | (2006.01) |

(52) U.S. Cl.

CPC ..... *F04F 5/46* (2013.01); *F02M 37/025* (2013.01); *F04F 5/10* (2013.01); *F04F 5/42* (2013.01); *F02M 37/106* (2013.01); *F02M 2037/225* (2013.01)

(58) Field of Classification Search

CPC ..... F04F 5/46; F04F 5/10; F04F 5/42; F02M 37/025; F02M 37/106; F02M 2037/225

See application file for complete search history.

(56) References Cited

U.S. PATENT DOCUMENTS

| | | | | | |
|---|---|---|---|---|---|
| 419,126 | A * | 1/1890 | Jones | F04F 5/46 | 417/198 |
| 1,742,996 | A * | 1/1930 | Liberty | F04F 5/42 | 417/198 |
| 3,886,972 | A * | 6/1975 | Scott | F15D 1/06 | 137/13 |

(Continued)

FOREIGN PATENT DOCUMENTS

| | | |
|---|---|---|
| DE | 4336061 | 4/1995 |
| DE | 10224696 | 12/2003 |

(Continued)

OTHER PUBLICATIONS

International Search Report for Application No. PCT/EP2012/053787 dated May 24, 2012 (English Translation, 3 pages).

*Primary Examiner* — Peter J Bertheaud
*Assistant Examiner* — Dnyanesh Kasture
(74) *Attorney, Agent, or Firm* — Michael Best & Friedrich LLP

(57) ABSTRACT

In a jet pump (22) for delivering fuel for a vehicle, a pre-filter for a nozzle (30) is formed in that a duct (47, 50) is formed between the nozzle (30) and a receptacle (36) for the nozzle in a pump body, the diameter of which duct is smaller than a diameter of a nozzle opening of the nozzle (30).

14 Claims, 4 Drawing Sheets

(56) References Cited

U.S. PATENT DOCUMENTS

| | | | | |
|---|---|---|---|---|
| 4,892,463 | A * | 1/1990 | Meyer | F04F 5/46 239/104 |
| 2005/0045159 | A1 | 3/2005 | Honda et al. | |

FOREIGN PATENT DOCUMENTS

| | | | |
|---|---|---|---|
| DE | 102008007204 | | 8/2009 |
| EP | 1433949 | | 6/2004 |
| GB | 2375086 | A | 11/2002 |
| JP | 4005126 | | 1/1992 |
| JP | 11117821 | | 4/1999 |
| JP | 2006022698 | | 1/2006 |
| WO | 2005001278 | | 1/2005 |
| WO | 2005042292 | | 5/2005 |

* cited by examiner

JET PUMP FOR DELIVERING FUEL

BACKGROUND OF THE INVENTION

The invention concerns a suction jet pump for delivering fuel, for example for a vehicle.

Many motor vehicles, such as for example cars, buses and trucks, have a fuel supply module which comprises a tank in which the fuel for the vehicle is stored. In the tank is a reservoir which is used to provide fuel even if the tank is almost empty or if the fuel is no longer evenly distributed in the tank due to centrifugal forces occurring during travel. A fuel pump can be located in the tank and for example is driven by an electric motor and delivers the fuel in the direction of the vehicle engine and in the direction of a jet pump. The jet pump serves to deliver fuel from the tank into the reservoir so that the reservoir always contains sufficient fuel. The fuel supply module thus has a reservoir actively filled by the jet pump.

The jet pump is a pump in which the pump action is generated by a jet of fuel which is produced by a small nozzle opening on the jet pump and which draws up further fuel from the tank, accelerates it and delivers it into the reservoir. The nozzle opening can have a diameter of around 0.6 mm and is usually protected by a pre-filter so that no particles in the fuel can clog the nozzle opening. For example the pre-filter can be provided as an additional part in the supply line to the jet pump.

In order to reduce the consumption of fuel by the jet pump as a propellant, which can reduce the energy consumption of the jet pump, the nozzle opening can be reduced. This can for example be achieved by a smaller diameter for the nozzle opening. Normally the jet pump is made of plastic, for example by means of injection molding, in particular as part of the reservoir wall. However on reduction of the nozzle opening, problems can arise since difficulties or errors can occur on forming a nozzle with a small nozzle opening in a large plastic mold. For example in this case the nozzle opening can break on removal of the formed jet pump from the mold.

The nozzle opening currently in general use, with a diameter around 0.6 mm, can be produced with a special part of the mold, which however creates an additional hole in the pump body of the jet pump. The additional hole must then be plugged with a further part, such as ball or similar.

SUMMARY OF THE INVENTION

The object of the invention is to provide an energy-saving jet pump which can be produced easily and economically.

This object is achieved by the subject of the independent claim. Further embodiments of the invention arise from the dependent claims and from the description below.

One aspect of the invention concerns a jet pump for delivering fuel, for example for a vehicle. The vehicle can be a car, a truck or a bus. In particular all vehicle types possible in the automotive sector can be considered. A jet pump according to the invention can also be advantageous for a motorcycle. The fuel can in particular be petrol or diesel. It is not however excluded that also other propellants, such as for example two-stroke mixture, can be delivered by the jet pump. In general the jet pump can also be used outside the automotive industry for example in mining, in the medical products sector, the foodstuff industry, in petrochemicals, in the chemical industry, or the heating and ventilation sector etc.

According to one embodiment of the invention, the jet pump comprises a pump body and a nozzle arranged in the pump body. The pump body can contain the two supply lines of the jet pump, wherein pressurized fuel is supplied to the jet pump via the first supply line and a second supply line serves to supply to the jet pump the fuel which is to be delivered by the jet pump. The fuel from the first supply line is pressed through the nozzle on operation of the jet pump, producing a jet of fuel which carries and thus conveys the fuel from the second supply line, generating the pump action of the jet pump.

The first supply line to supply pressurized fuel to the receptacle can open in the receptacle next to the nozzle in relation to an axial extension direction of the nozzle or receptacle.

According to an embodiment of the invention, the jet pump furthermore comprises a pre-filter for filtering fuel upstream of the nozzle. The pre-filter serves to filter out particles from the fuel which could block the nozzle.

According to one embodiment of the invention, the nozzle has an annular wall and a cover with a nozzle opening which closes the annular wall, wherein the nozzle with the annular wall is arranged in a receptacle in the pump body. For example the nozzle can be a rotationally-shaped body in which the annular wall is cylindrical and the cover is substantially formed as a truncated cone, the tip of which forms the nozzle opening. Conversely the receptacle in the pump body can be a tubular opening to which the first supply line for the pressurized fuel is connected, and in which the rear part of the nozzle with the annular wall is inserted. For example in this way a nozzle with a small opening diameter can be inserted in the receptacle in the pump body, wherein the nozzle was cast separately from the pump body in a mold which is small in relation to the mold for the pump body. In this way the small opening diameter of the nozzle can be created easily and reliably.

The increased pressure in front of the nozzle (i.e. upstream of the nozzle opening) from the smaller nozzle opening can lead to less fuel vapor being present in the pressurized fuel, which, in particular in the case of hot fuel, can further increase the efficiency of the jet pump.

The diameter of the nozzle opening can for example in this case be around 0.5 mm or less. With a small mold for example, a nozzle opening of 0.4 mm but also 0.3 mm can be achieved.

According to one embodiment the pre-filter for the nozzle is formed in that a duct is formed between the nozzle, for example the annular wall, and the receptacle, the diameter of which duct is smaller than the diameter of an opening of the nozzle. The nozzle inserted in the pump body can, together with the receptacle, form a duct which can capture particles from the fuel which could enter the nozzle opening. In this way the opening of the nozzle is protected from clogging, without a separate pre-filter having to be provided upstream of the nozzle in the jet pump. Between the annular wall of the nozzle and the receptacle, a filter region can thus be formed which can be dimensioned such that the entire volume of particles, which are expected to enter the jet pump over the entire life of the jet pump, can be captured by the filter region.

According to one embodiment of the invention, the duct is formed in the pump body between an outside of the annular wall and an inside of the receptacle. For example the annular wall can have a greater outer diameter in a front region than in a rear region of the nozzle. The front region of the annular wall can here be dimensioned such that it closes the receptacle, so that the fuel flows around the rear part of the annular wall before it enters the interior of the nozzle. In this way a duct can be formed as a labyrinth between the receptacle and the nozzle, providing the filter region of the jet pump.

According to one embodiment of the invention the pump body has a mandrel which protrudes into the annular wall. The duct or filter region can be formed between the inside of the annular wall and an outside of the mandrel. In this way too, an annular filter region can be formed which is adapted to keep out particles which are too large to pass through the filter opening.

In particular the filter region or the duct can be formed on the outside and inside of the end segment of the annular wall, such that the fuel flows around the rear part of the annular wall firstly on the outside and then past the mandrel on the inside, before reaching the nozzle opening. In this way a particularly compact duct or filter region can be formed.

According to one embodiment of the invention the duct surrounds the annular wall substantially completely. In this way the volume of the duct can be designed large enough to capture particularly many particles, which can guarantee a very long life of the jet pump. Additionally or alternatively it is also possible for the duct to surround the mandrel, which protrudes into the annular wall, substantially completely in the radial direction. In particular in combination with a duct which surrounds the annular wall on the outside, in this way a particularly large volume for the filter region can be provided.

According to one embodiment of the invention, the duct has ribs which extend in axial direction of the annular wall. These ribs can protrude in the radial direction so far from the receptacle or mandrel or annular wall that recesses are formed in the duct, through which the fuel and any particles present therein must flow. In other words multiple ducts can be formed by ribs in the filter region, or the duct can comprise multiple individual ducts, the diameter of which is determined by the mutual spacing of the ribs and by the spacing of the inner wall of the receptacle and the outer wall of the annular wall, or of the inner wall of the annular wall and the outer wall of the mandrel. Each of these individual ducts can also extend in the axial direction of the nozzle.

According to one embodiment of the invention, the ribs are formed integrally with the nozzle. For example the ribs are mounted on the outside or the inside of the annular wall. In this way the ribs together with the nozzle can be produced in the small mold mentioned above for the jet pump nozzle, whereby it is possible to produce the ribs or the ducts formed in-between with precisely the correct size.

According to one embodiment of the invention, the ribs are formed integrally with the receptacle or pump body. For example the ribs can also be mounted on an outside of a mandrel protruding into the annular receptacle. In this way the ribs can be produced or formed in the mold for the pump body of the jet pump.

According to one embodiment of the invention, the pump body is formed in a wall of a fuel reservoir. In this way it is not necessary to produce separately the pump body and fuel reservoir which may be located in the tank of the vehicle. The two parts can be produced in one working process, which can reduce their production costs.

According to one embodiment of the invention, the pump body is formed integrally. As already stated, the pump body can be formed in a single work process in a large mold, wherein there is no need to ensure that exactly the correct size of nozzle opening is molded. The nozzle can also be formed integrally, in particular in a small mold which is specially designed for molding the constituents of the nozzle, such as a nozzle opening and the ribs, with particular precision.

A further aspect of the invention concerns a fuel supply module for the jet pump and a reservoir which is adapted to receive the fuel delivered by the jet pump. A further pump can then be arranged in the reservoir to supply the jet pump with pressurized fuel and also to deliver fuel from the reservoir in the direction of the vehicle's internal combustion engine. Such a fuel supply module can be produced more cheaply with the jet pump as described above and below, can have fewer parts than a conventional fuel supply module and also be operated with less energy, since the pump in the reservoir need deliver less fuel to the jet pump.

BRIEF DESCRIPTION OF THE DRAWINGS

Exemplary embodiments of the invention are described in detail below with reference to the enclosed figures.

In principle identical or similar parts carry the same reference numerals.

DETAILED DESCRIPTION

Figure 1:
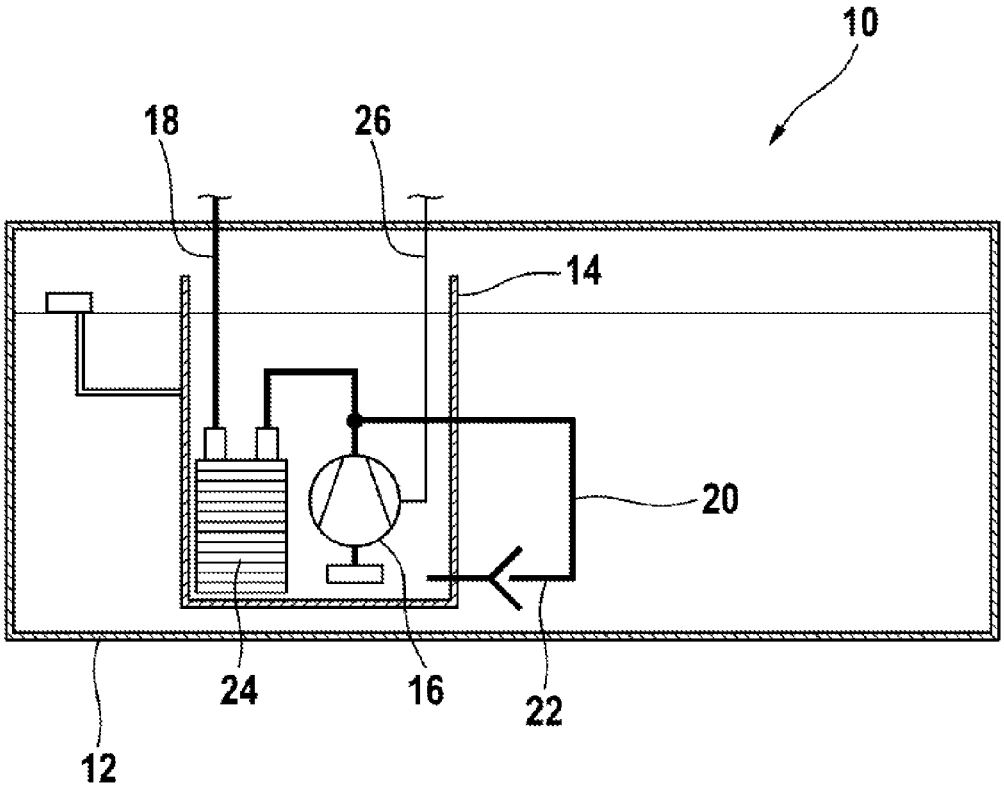
FIG. 1 shows diagrammatically a fuel supply module according to one embodiment of the invention.

FIG. 1 shows diagrammatically a fuel supply module 10 comprising a fuel tank 12 in which is arranged a reservoir 14. In the reservoir 14 is a pump 16 which is adapted to deliver fuel via a first line 18 in the direction of an internal combustion engine, and to deliver fuel via a second line 20 from the reservoir 14 in the direction of a jet pump 22. The jet pump 22 is adapted to deliver fuel from the tank 12 into the reservoir 14. A fuel filter 24 can be located in the line 18 to filter the fuel delivered in the direction of the combustion engine. The pump 16 within the reservoir 14 can be operated by an electric motor which is supplied with electrical power via a line 26.

Figure 2:
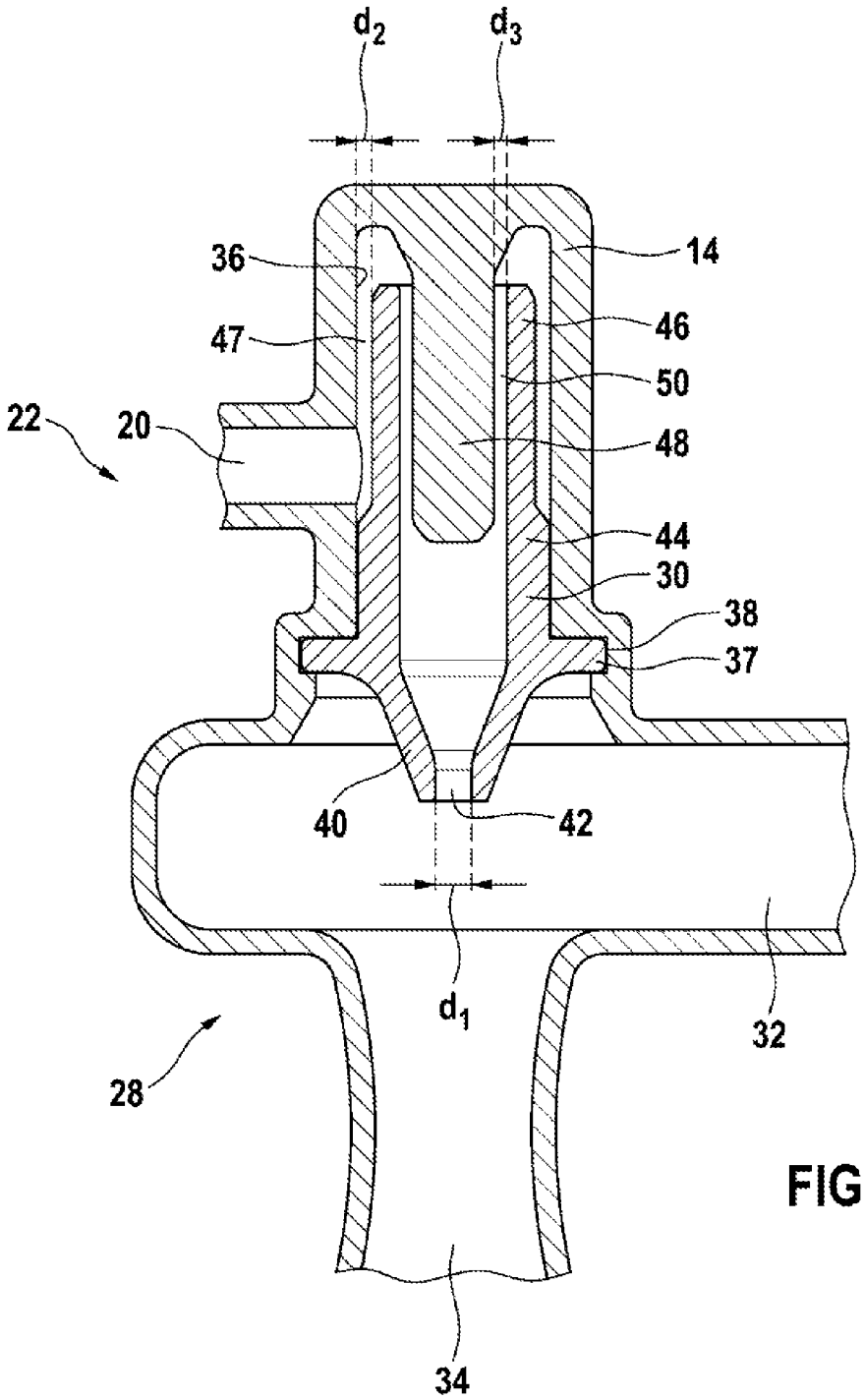
FIG. 2 shows a longitudinal section through a jet pump according to one embodiment of the invention.

FIG. 2 shows a diagrammatic longitudinal section through a suction jet pump 22. The jet pump 22 comprises a pump body 28 formed from a first material and a nozzle 30 which is formed from a second material separate from the pump body 28. The pump body 28 can be formed of the same plastic as the nozzle 30. It is however also possible for the pump body 28 and the nozzle 30 to be formed from different plastic materials.

In the pump body 28 is formed a first supply line 20, via which the pressurized fuel originating from the pump 16 can enter the jet pump 22; the pump body 20 however also has a second supply line 32 which is connected to the tank 12. In addition a mixer pipe 34 is formed in the pump body 28, through which the fuel from the supply line 32 and the fuel jet from the nozzle 30 are mixed and delivered in the direction of an outlet into the reservoir 14.

A receptacle 36 is formed in the pump body 28 and the nozzle 30 is inserted therein. The receptacle 36 is a tubular opening or recess in the pump body 28 which extends in the axial direction in which the nozzle 30 and the mixer pipe 34 also extend. The supply line 20 for the pressurized fuel opens into the receptacle 36 at the side. The receptacle 36 substantially has the same diameter over the entire axial extension direction. One exception is a groove 38 in the front region of the receptacle 36, which groove is adapted to receive an annular protrusion 37 extending radially about the nozzle 30 and serves to hold the nozzle 30 in the receptacle 36, in that the protrusion 37 engages in the groove 38.

The nozzle 30 again in the front region has a substantially frustoconical cover 40, at the tip of which is formed the nozzle opening 42. The cover 40 is connected to an annular wall 44 which in a first segment has the same outer diameter as the inner diameter of the receptacle 36, whereby the fuel from the line 20 is forced to flow into the interior of the nozzle 30 and leave the nozzle 30 only via the nozzle opening 42.

In a further segment 46 the nozzle 30 has an outer diameter which is smaller than the outer diameter of the receptacle 36. Thus in this region a duct 47 is formed between the inner wall of the receptacle 36 and the outer wall of the nozzle 30, through which duct the fuel from the line 20, which opens into the receptacle 36 in the region of the segment 46, flows into the interior of the nozzle 30. At the end of the receptacle 36 a mandrel 48 is formed in the pump body 28 and protrudes into the interior of the nozzle 30. The outer diameter of the mandrel 48 is smaller than the inner diameter of the nozzle 30, so that in this region a further duct 50 is formed, through which the fuel from the supply line 20 or duct 47 must flow before it can leave the nozzle 30 through the nozzle opening 42.

The receptacle 36 is substantially cup-like, wherein the mandrel 48 protrudes from its base region in the axial direction. The mandrel 48 is a substantially cylindrical body, the end of which is slightly chamfered in the opening direction of the receptacle 36.

Because diameter $d_1$ of the nozzle opening 42 is greater than diameter $d_2$ of the duct 47 and diameter $d_3$ of the duct 50, ducts 47 and 50 form a filter region in which particles in the fuel from the supply line 20 can be captured so that the nozzle opening 42 cannot clog.

Figure 3:
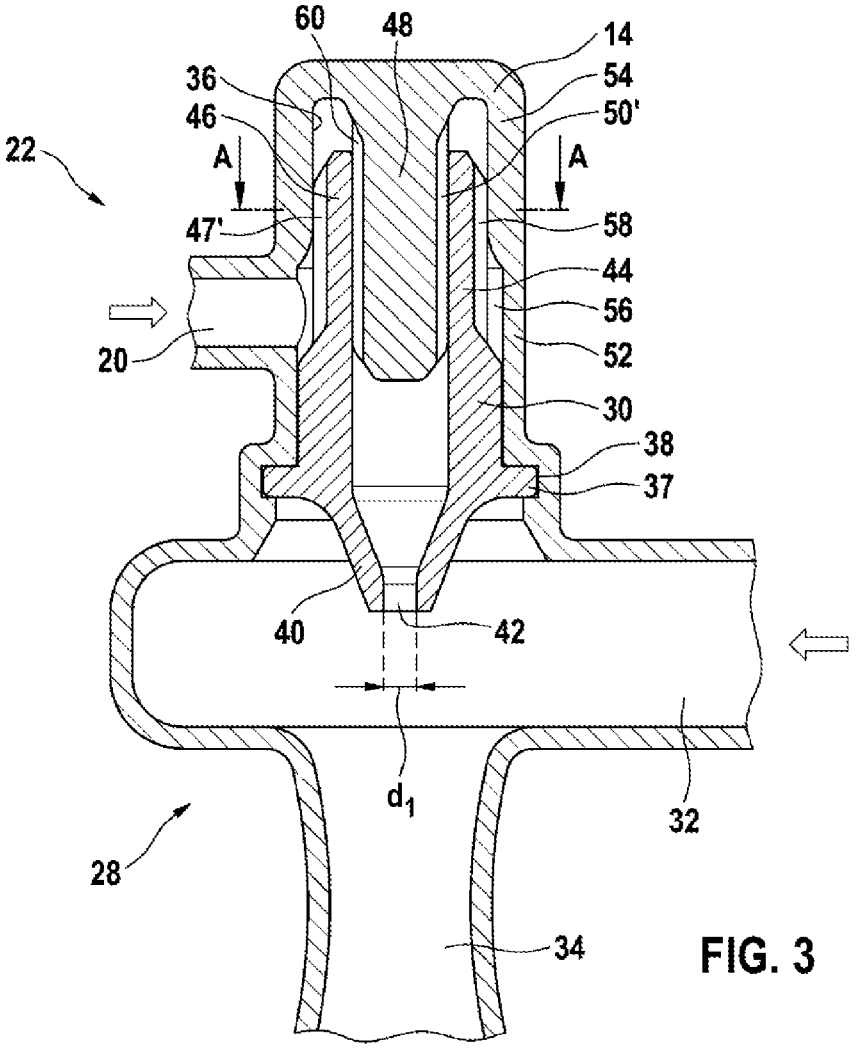
FIG. 3 shows a longitudinal section through a jet pump according to a further embodiment of the invention.

FIG. 3 shows a further embodiment of a jet pump 22 which is substantially constructed like the jet pump 22 in FIG. 2. The jet pump 22 in FIG. 3 however has a receptacle 36 which has a greater diameter in a first segment 52 than in a second segment 52 which is further remote from the opening 42 of the nozzle 30. Since the supply line 20 opens into the receptacle 36 in the region 52, and the nozzle 30 has a smaller outer diameter in a segment of the region 52 than in the segment 52, in this region an annular cavity 56 is created in which the fuel from the line 20 can be distributed about the entire nozzle 30. In addition the jet pump 22 from FIG. 3 differs from that in FIG. 2 in that the nozzle 30 on its rear region has ribs 58 extending in the axial direction, and the mandrel 48 has ribs 60 extending in the axial direction.

Figure 4:
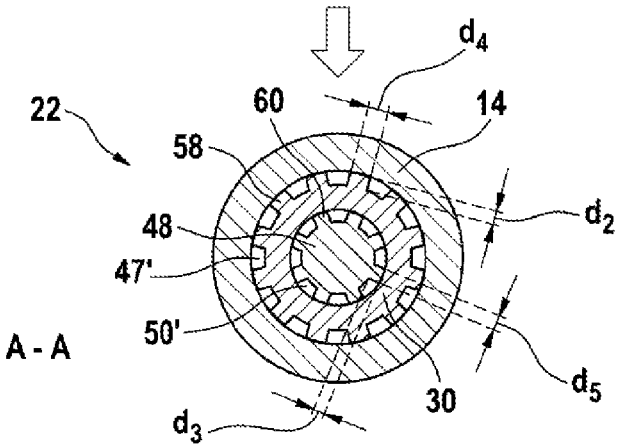
FIG. 4 shows a cross section through the jet pump shown in FIG. 3.

This is more clearly evident in FIG. 4 which shows a cross section through the jet pump 22 from FIG. 3 along line A-A. As shown in FIG. 4, the mandrel 48 together with its ribs 60 has an outer diameter which corresponds to the inner diameter of the nozzle 30 on a section line, wherein the ribs 60 have a height $d_3$ in the radial direction and a spacing $d_5$ in the peripheral direction. Thus between the mandrel 48 and the nozzle 30, a plurality of ducts 50' are formed, the diameter and cross section area of which are defined by the diameters $d_3$ and $d_5$.

Similarly, the nozzle 30 on its outside has ribs 58 which touch the receptacle 36 in the region of the section line A-A. Thus the nozzle 30 in this region has an outer diameter which corresponds to the inner diameter of the receptacle 36 at this region. The ribs 58 of the nozzle 30 have a spacing $d_4$ and a radial height $d_2$. Thus between the inner face of the receptacle 36 and the outer face of the nozzle 30, a plurality of ducts 47' is formed. The diameter and cross section area of the ducts 47' are defined by the diameters $d_2$ and $d_4$.

As evident from FIG. 3, the pressurized fuel flows from the supply line 20 first into the annular region 56 about the nozzle 30 where it is distributed, in order then to flow through the ducts 47' into the rearmost region of the receptacle 36, from there via the ducts 50' into the interior of the nozzle 30, and thereafter to leave the nozzle 30 through the opening 42. The diameters $d_3$ and $d_5$ of ducts 50' and diameters $d_2$ and $d_4$ of ducts 47' are dimensioned such that particles present in the fuel can remain captured therein if they are large enough to clog the nozzle opening 42. In this way a filter region is formed in the jet pump 22, which comprises the components 56, 50' and 47'.

Ribs 60 and 58 on mandrel 48 and at nozzle 30 can also serve to support the nozzle 30 in the receptacle 36 and on the mandrel 48, so that the rear region of the nozzle 30 or the front part of the mandrel 38 cannot swing to and from even under vibration. In this way it is ensured that the ducts 50' and 47' always have precisely the same diameter.

Figure 5:
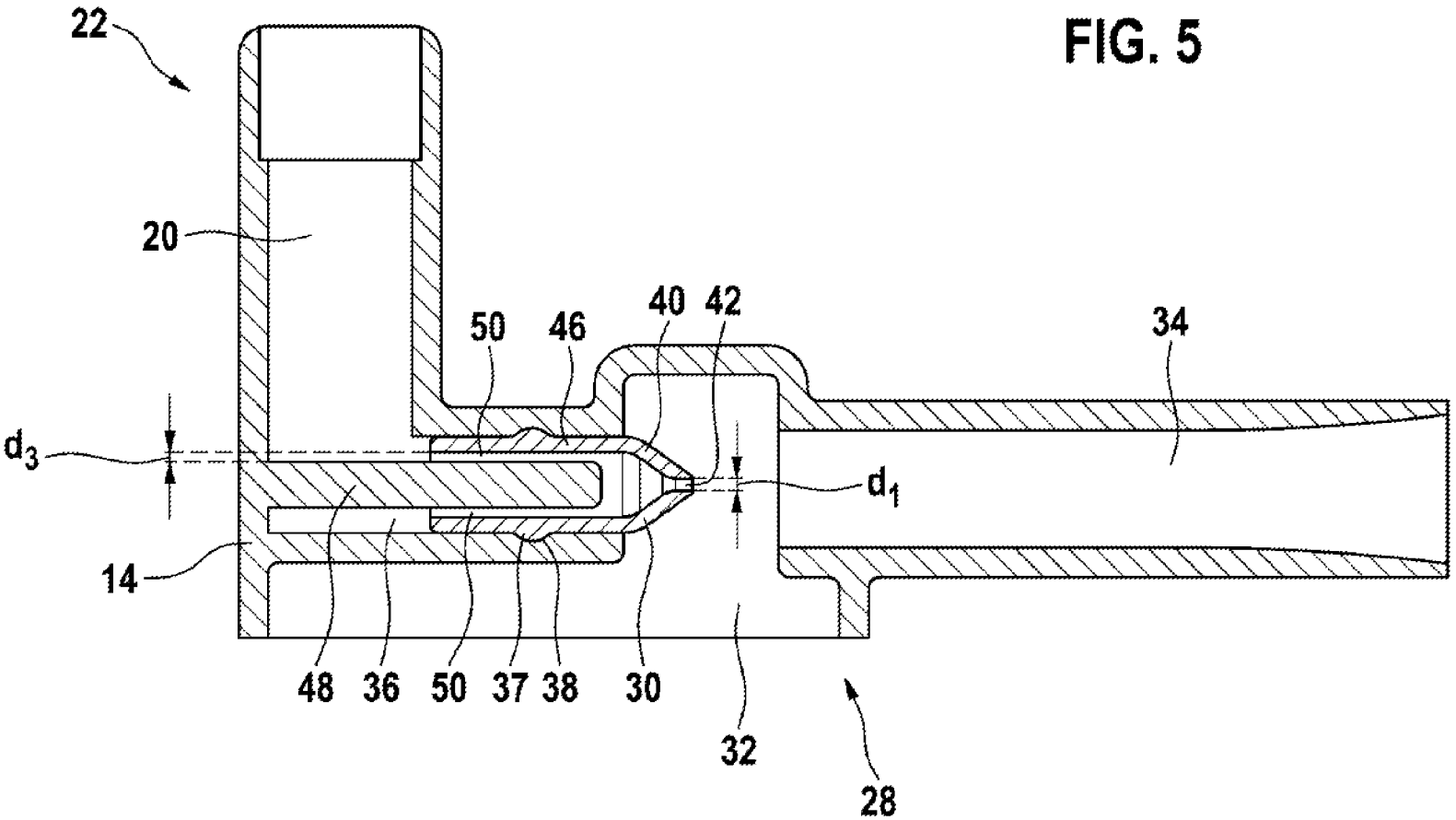
FIG. 5 shows a longitudinal section through a jet pump according to a further embodiment of the invention.

FIG. 5 shows a further embodiment of a jet pump 22 in which the nozzle 30 has an annular wall 46, the outer diameter of which corresponds with the inner diameter of the receptacle 36 over the entire extension of the annular wall 46 in the radial direction. The inner diameter of the annular wall 46 in the region of the mandrel 48 is here slightly larger than the outer diameter of the mandrel 48 at this point. The inner diameter of the nozzle 30 and the outer diameter of the mandrel 48 are dimensioned such that their spacing $d_3$ is smaller than diameter $d_1$ of the nozzle opening 42. In this way an annular filter region 50 or duct 50 is formed about the mandrel 48, in which particles can be captured which would otherwise clog the nozzle opening 42.

In the jet pump 22 in FIG. 5, the supply line 22 opens in the axial direction into the duct 50. In a segment which is not surrounded by the nozzle 30, the fuel from the supply line 20 can flow around the mandrel 48 so that it can flow around the entire mandrel 48 in the duct 50.

In addition it must be pointed out that the term "comprising" does not exclude other elements or steps, and the terms "one" or "a" do not exclude a plurality. Furthermore it is pointed out that features or steps which are described with reference to one of the exemplary embodiments above can also be used in combination with other features or steps of other exemplary embodiments described above. Reference numerals in the claims should not be regarded as a restriction.

The invention claimed is:

1. A jet pump (22) for delivering fuel, the jet pump comprising:

a pump body (28) having a supply line (20) through which pressurized fuel enters the pump body (28), and a nozzle (30) having a nozzle opening (42) and an interior that opens into the nozzle opening (42), the nozzle (30) is arranged in a receptacle (36) in the pump body (28) and can be supplied with fuel via the supply line (20), wherein the receptacle (36) of the pump body (28) extends in an axial direction, the supply line (20) communicates with the receptacle (36), and a pre-filter is provided upstream of the nozzle (30), characterized in that the pre-filter for the nozzle (30) is defined by a duct having at least one gap that is formed between the nozzle (30) and the receptacle (36), the duct communicating with the interior of the nozzle (30), wherein fuel from the supply line (20) flows through the gap in an opposite direction to flow through the interior of the nozzle, the gap having a dimension (d2) in a radial direction that is smaller than a diameter of the opening (42) of the nozzle (30).

2. The jet pump (22) as claimed in claim 1, wherein the nozzle (30) has an annular wall (46) and a cover (40) that defines the nozzle opening (42), wherein the nozzle (30) with the annular wall (46) is arranged in the receptacle (36), wherein the duct is formed between an outside of the annular wall (46) and the receptacle (36) in the pump body (28).

3. The jet pump (22) as claimed in claim 1, wherein the pump body (28) has a mandrel (48) which protrudes into an annular wall (46) of the nozzle (30).

4. The jet pump (22) as claimed in claim 3, wherein the duct further extends between an inside of the annular wall (46) and the mandrel (48).

5. The jet pump (22) as claimed in claim 1, wherein the duct surrounds the nozzle (30).

6. The jet pump (22) as claimed in claim 1, wherein ribs (58, 60) are arranged in the duct.

7. The jet pump (22) as claimed in claim 6, wherein the ribs (58) are formed integrally with the nozzle (30).

8. The jet pump (22) as claimed in claim 6, wherein the ribs are formed integrally with the receptacle.

9. The jet pump (22) as claimed in claim 6, wherein the ribs (60) are mounted on an outside of a mandrel (48) protruding into the receptacle (36).

10. The jet pump (22) as claimed in claim 9, wherein the ribs are formed integrally with the receptacle.

11. The jet pump (22) as claimed in claim 1, wherein the pump body (28) is formed in a wall of a fuel reservoir (14).

12. The jet pump (22) as claimed in claim 1, wherein at least one of the pump body (28) and the nozzle (30) is formed integrally.

13. The jet pump (22) as claimed in claim 1, wherein a portion of the duct surrounds a mandrel (48), which protrudes into the nozzle (30).

14. The jet pump (22) as claimed in claim 13, wherein a portion of the duct surrounds the nozzle (30).

* * * * *